US006460628B1

(12) United States Patent
Day et al.

(10) Patent No.: US 6,460,628 B1
(45) Date of Patent: Oct. 8, 2002

(54) RAPPER ASSEMBLY

(75) Inventors: William E. Day, Tooele, UT (US); Lester J. Anderson, West Jordan, UT (US); Vaughn Bowcutt, Salt Lake City, UT (US)

(73) Assignee: Kennecott Utah Copper Corporation, Magna, UT (US)

( * ) Notice: Subject to any disclaimer, the term of this patent is extended or adjusted under 35 U.S.C. 154(b) by 0 days.

(21) Appl. No.: 09/516,126

(22) Filed: Feb. 28, 2000

(51) Int. Cl.[7] ..... B25D 11/00
(52) U.S. Cl. ..... 173/100; 173/101; 173/117
(58) Field of Search ..... 173/99, 100, 101, 173/117, 124, 131; 81/20, 25, 26

(56) References Cited

U.S. PATENT DOCUMENTS 2,893,279 A * 7/1959 Haskel et al. ..... 123/183.1
3,948,301 A * 4/1976 Hays ..... 81/19
4,831,901 A * 5/1989 Kinne ..... 81/20
5,216,939 A * 6/1993 Swenson ..... 81/20
5,443,654 A 8/1995 Hiltunen et al. ..... 134/22.12

* cited by examiner

*Primary Examiner*—Scott A. Smith
*Assistant Examiner*—Chukwurah Nathaniel
(74) *Attorney, Agent, or Firm*—Whyte Hirschboeck Dudek SC

(57) ABSTRACT

The conventional rapper design is improved to provide longer service without maintenance and easier access at less cost when service is required by, among other things, redesign of the hammer assembly, hammer shaft and lever assemblies, and the hammer assembly housings. Design improvements include the provision of access panels on the housings, a guide and lock mechanism for removing and inserting the hammer assembly out of and into the hammer assembly housing, providing the hammer with a removal, and keyed engagements of hammer shaft assembly components.

6 Claims, 8 Drawing Sheets

215
214
201
229
318b
202
211b
325b
203
320b
320a
327a
319
324a
327b
207
206
226b
209
324b
323a
208
525a
228a
228b
323c
323d
323d

FIG. 8
PRIOR ART
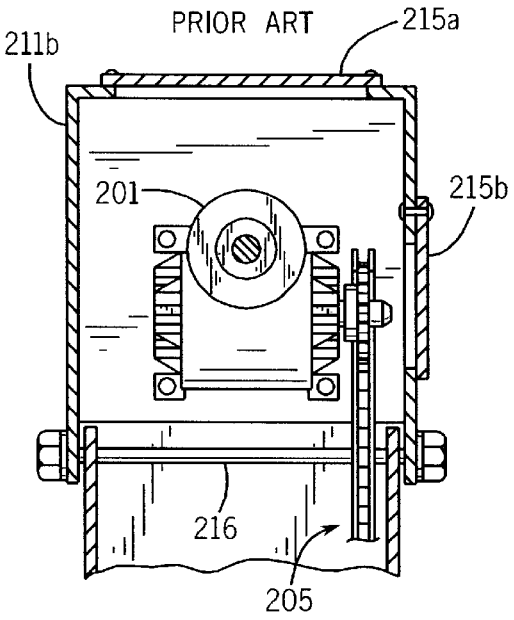
FIG. 9
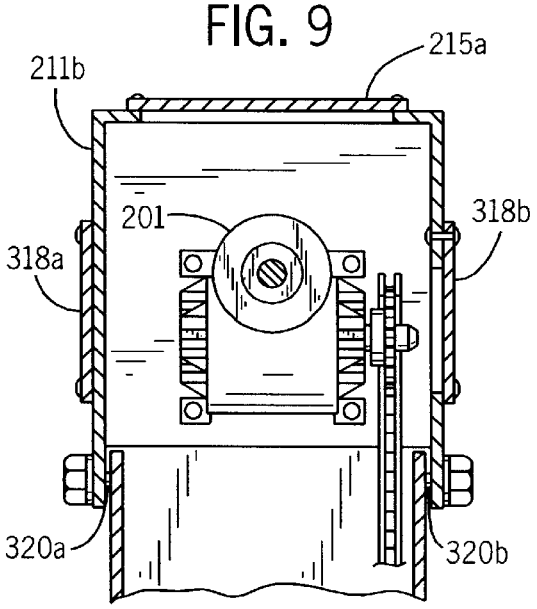
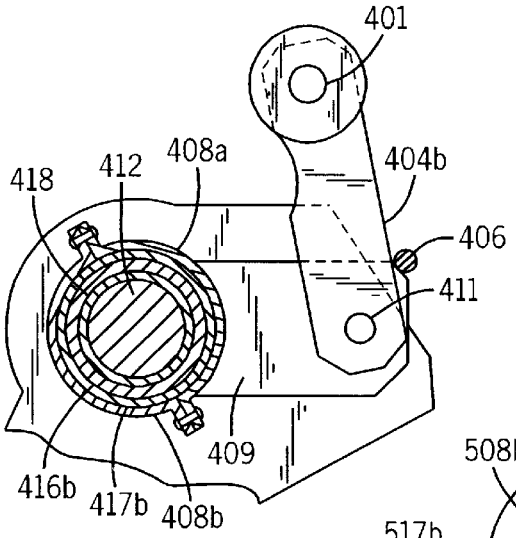
FIG. 12
PRIOR ART
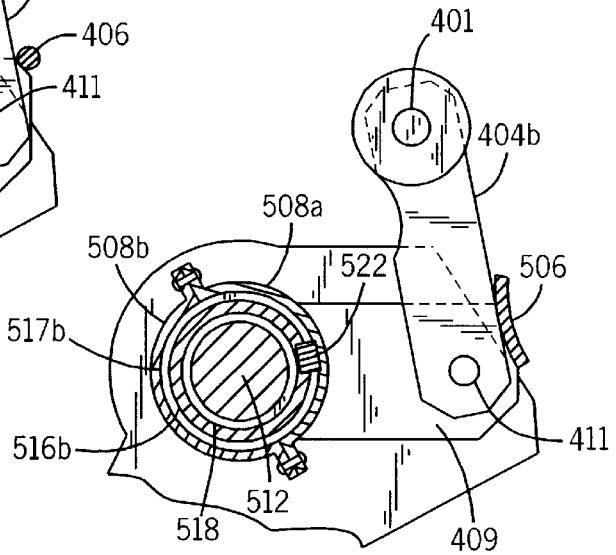
FIG. 13

RAPPER ASSEMBLY

FIELD OF THE INVENTION

This invention relates to the maintenance and efficient operation of equipment designed to transport or process hot, dust-laden gases. In one aspect, this invention relates to maintenance equipment designed to prevent or retard the deposit of sticky solids on the interior walls and internal components of the hot, dust-laden gas transport/process equipment while in another aspect, the invention relates to such maintenance equipment that impacts or causes a temporary deformation or vibration of the interior wall of the transport/process equipment. In yet another aspect, the invention relates to design improvements to such maintenance equipment.

BACKGROUND OF THE INVENTION

Hiltunen and Ikonen, U.S. Pat. No. 5,443,654 which is incorporated herein by reference, provide a reasonably good description of the problem of deposit buildup in equipment designed and operated for transporting and/or processing hot, dust-laden gases. Hiltunen and Ikonen teach this problem in the context of a gas cooler inlet duct, but this problem is common to most equipment through which hot, dust-laden gases pass. As here used, "dust-laden" includes gases containing molten or evaporated material. As such gases cool and condense, the dust components may, depending upon their composition, become sticky and adhere to one another and the internal walls and components of the equipment in which the gas is contained. These deposits can grow quickly and interfere with the safe and efficient operation of the gas transport/processing equipment. For example, these deposits can block gas flow and/or reduce the efficiency of heat transfer between the hot gas and the gas transport/processing equipment walls and internals, e.g., heat-exchange tubes. Moreover, depending upon the design and materials from which the transport/processing equipment is constructed, e.g., metal, ceramic, etc., removal of these deposits can be difficult or less than 100% effective if the deposits are allowed to accrete beyond a certain size.

Various methods are known for preventing or retarding deposit formation within hot, dust-laden gas transport and/or processing equipment, and these methods include increasing the gas volume and/or turbulence, various scrubbing techniques, and imparting a slight but frequent deformation to the walls and/or components of the equipment to which the sticky, cooled dust is likely to adhere. As noted by Hiltunen and Ikonen, these deposits tend to be brittle and subject to removal through mechanical deflection of the wall or structure upon which they are deposited.

Various methods are known for imparting a mechanical force to a surface to which a deposit may or has formed to either prevent or remove the deposit. Hiltunen and Ikonen teach one such method. Another is taught in FIGS. 1, 2, 4, 6, 8, 10 and 12 in which like numerals are employed to designate like parts throughout the Figures. Various items of equipment such as electrical connections, fittings and the like are omitted so as to simply the drawings.

FIG. 1 illustrates a "rapper" 100 attached by any conventional means, here by brace 101, to the wall (shown in partial section) of a waste-heat boiler. The wall comprises exterior metal skin 102 and ceramic insulation 103. The waste-heat boiler contains a plurality of heat-exchange tubes 104 (only one of which is shown) over and around which hot, dust-laden gases from any source, e.g., a metallurgical furnace, circulate. The tubes contain any suitable heat-exchange fluid (not shown) designed to capture by convection through the tube wall at least part of the latent heat of the gas. This transfer of heat from the gas to the heat-exchange fluid within the tube causes the gas to cool, and thus the dust components within the gas to condense and deposit on, among other places, the exterior walls of the tubes. Since the deposits of this example tend to be brittle in nature, their formation is impede or if formed, then easily removed, by imparting a mechanical force in the form of a small deflection or vibration to the wall of the heat-exchange tube. These tubes are often placed in contact with one another, and thus the vibration imparted to one tube is readily transferred to all of the other tubes to which it is in direct or indirect contact.

Rapper 100 imparts a mechanical force to heat-exchange tube 104 through the action of hammer 105 striking anvil 106. Hammer 105 operates in a manner described below such that it periodically is retracted to a predetermined distance from the face of the anvil (e.g., 12–14 inches), and then released such that the face of the hammer impacts the face of the anvil with a predetermined amount of force. This force is transferred from the face of anvil 106 through disc spring 107 and anvil rod 108 to I-bar 109 and ultimately to tube 104 (and those tubes in direct or indirect contact with tube 104). I-bar 109 and anvil rod 108 are embedded in insulation 103 in such a manner that the majority of the mechanical force is transfer to tube 104 and not skin 102 or insulation 103.

The principal components of the rapper are shown in FIG. 2. The power to activate the hammer is provided by electric motor 201 which is operationally connected to gear reducer 202. Shaft 203 of gear reducer 202 connects to and drives hammer assembly 204 by way of chain drive assembly 205 which consists of small chain sprocket 206, chain 207 and large chain sprocket 208. The chain drive assembly rotates hammer shaft assembly 210 and lever shaft assembly 209 (both shown in exploded format in FIG. 4), which in turn provide the action by which the hammer periodically is retracted and released to impact the anvil. Hammer assembly 204 is aligned within two piece hammer housing 211*a* and 211*b* such that the lever shaft assembly engages adjustable cam 212. Lever shaft assembly 209 rotates in such a manner that once each rotation it engages cam riser 213. As lever shaft assembly 209 passes over cam riser 213, the hammer shaft assembly is disengaged from the chain drive assembly, and the hammer "falls" into the face of the anvil. Once the lever shaft assembly has cleared the cam riser, the hammer shaft assembly re-engages the chain drive assembly and the hammer is retracted and retained into its retracted position until the lever shaft assembly again engages the cam riser.

The amount of force delivered to the anvil is a function, in part, of the position of the cam riser on the cam. In this manner, the amount of force delivered to the anvil by the fall of the hammer can be controlled. Gear reducer 202 is housed in gear reducer housing 214 which is fastened by any suitable means to hammer housing 211*a*.

FIG. 4 is an exploded view of lever shaft assembly 209 and hammer shaft assembly 210. The lever shaft assembly comprises a lever shaft 401 carrying a middle bearing 402 and two bushings 403*a* and 404*b*. Bushing 403*a* carries lever 404*a* and bushing 403*b* carries lever 404*b*. Outside bearings 405*a* and 405*b* complete the complement of elements carried by lever shaft 401.

Shaft 401 is aligned with cam 212 and cam riser 213 such that bearing 402 engages cam riser 213 once each rotation of hammer shaft assembly 210, and bearings 405*a* and 405*b* engage hammer cams 407*a* and 407*b*, respectively. Lever shaft assembly 209 is connected to hammer shaft assembly by two-piece hammer shaft casing 408*a* and 408*b*. Casing 408*a* includes casing arm 409 designed to receive casing arm bushing 410 and casing arm shaft 411 to which levers 404*a* and 404*b* can attached in any conventional manner. In operation, the back of levers 404*a–b* engage stop pin 406 (FIG. 12) after the hammer falls into the face of the anvil. This engagement steadies (i.e., dampens the vibration of) the hammer and thus facilitates an easy re-engagement of the hammer shaft assembly with the chain drive assembly. Hammer shaft 412 is fitted to hammer 105 by way of hammer arms 413*a–b* each of which fare fastened to hammer 105 by any conventional means, e.g., welding. Each hammer arm contains an opening 414*a* and 414*b* respectively in alignment with one another and adapted to receive hammer shaft 412 with its complement of bushings 416*a–b*, 417*a–b* and 418. Hammer shaft 412 is fitted within bushing 418 such that it extends out of both open ends of the bushing. Openings 414*a–b* are fitted with bushings 416*a–b*, respectively. Bushing 418 with inserted hammer shaft 412 is inserted through bushings 416*a–b* such that it extends through both. Casing 408*a–b* engages bushing 418 about its central section in a compression fit, and bushings 417*a–b* are fitted between the respective inner surfaces of arms 413*a–b* and casing 408*a–b*. Bushing 418 has neck 418*a* which is fitted into sprocket opening 230 and then welded or otherwise permanently fastened to sprocket 208. Hammer arm block 419 contributes stability to the hammer assembly.

Spacer 415 also contributes stability to the hammer assembly. It is fitted over the end of bushing 418 that extends through opening 414*a* to occupy the space between the outer surface of arm 413*a* and the inner surface of housing 211*b* that is opposite arm 413*a*. Sprocket 208 provides a similar stability function by occupying the space between the outer surface of arm 413*b* and the inner surface of housing 211*b* that is opposite arm 413*b*. In both instances, this spacer and sprocket tend to restrict the movement of the hammer assembly relative to the hammer housing.

While the rapper described above performs reasonably well, often it proves difficult to service. Since rappers are in frequent use (a typical cycle for a rapper attached to a waste-heat boiler servicing a metallurgical furnace, e.g. a copper converter, is for the hammer to strike the anvil four or five times a minute for five minutes, remain at rest for fifteen minutes, and then repeat the cycle for as long as the furnace is in operation (which may be a year or more)), they require constant service. Rappers are often large, heavy pieces of equipment (the hammer assembly alone usually weighs more than one hundred pounds), and are often located in difficult to reach and/or service areas (e.g., high above ground, in tight corners, attached at odd angles, etc.). Moreover, on larger hot gas, dust-laden transport/processing equipment such as that associated with copper metallurgical furnaces, hundreds of rappers may be in service at one time, many located in close proximity to one another. Considerations such as these necessitate designs that favor relatively easy and inexpensive servicing.

SUMMARY OF THE INVENTION

The conventional rapper design is improved to provide longer service without maintenance and easier access at less cost when service is required. These improved results are through one or more of the following:

1. easier access to the hammer assembly and gear reducer without removal of their respective housings;
2. easier removal of the gear reducer housing and the hammer assembly housing when required;
3. easier removal of the hammer;
4. increased life of rapper components, and emphasizing inexpensive components for failure points (as opposed to expensive components); and
5. redesign of the hammer and various components of the lever and hammer shaft assemblies.

These and other features of the intention are described more filly below and by reference to the drawings.

BRIEF DESCRIPTION OF THE DRAWINGS

FIG. 8 is FIG. 6 taken along line 8—8.

FIG. 9 is FIG. 7 taken along line 9—9.

FIG. 12 is a side perspective of the lever engaging the stop pin of a conventional rapper.

FIG. 13 is a side perspective of the lever engaging the stop block of a rapper of the invention.

DETAILED DESCRIPTION OF THE INVENTION

Rappers are in use when the hot, dust-laden gas transport or process equipment to which they are attached is in use. Since such equipment, e.g., a metallurgical furnace and its associated equipment (boilers, flues, etc.) are designed for long-term (e.g., months or years) continuous use, rappers are also designed for such use. For rappers attached to a waste heat boiler supporting a metallurgical smelting or converting furnace, the rappers may operate on a cycle of five to ten raps per minute for five minutes, ten minutes at rest, and then the cycle repeats. Such continuous use results in wear and deterioration of the various rapper components and as such, rappers require regular inspection and maintenance.

Figure 2:
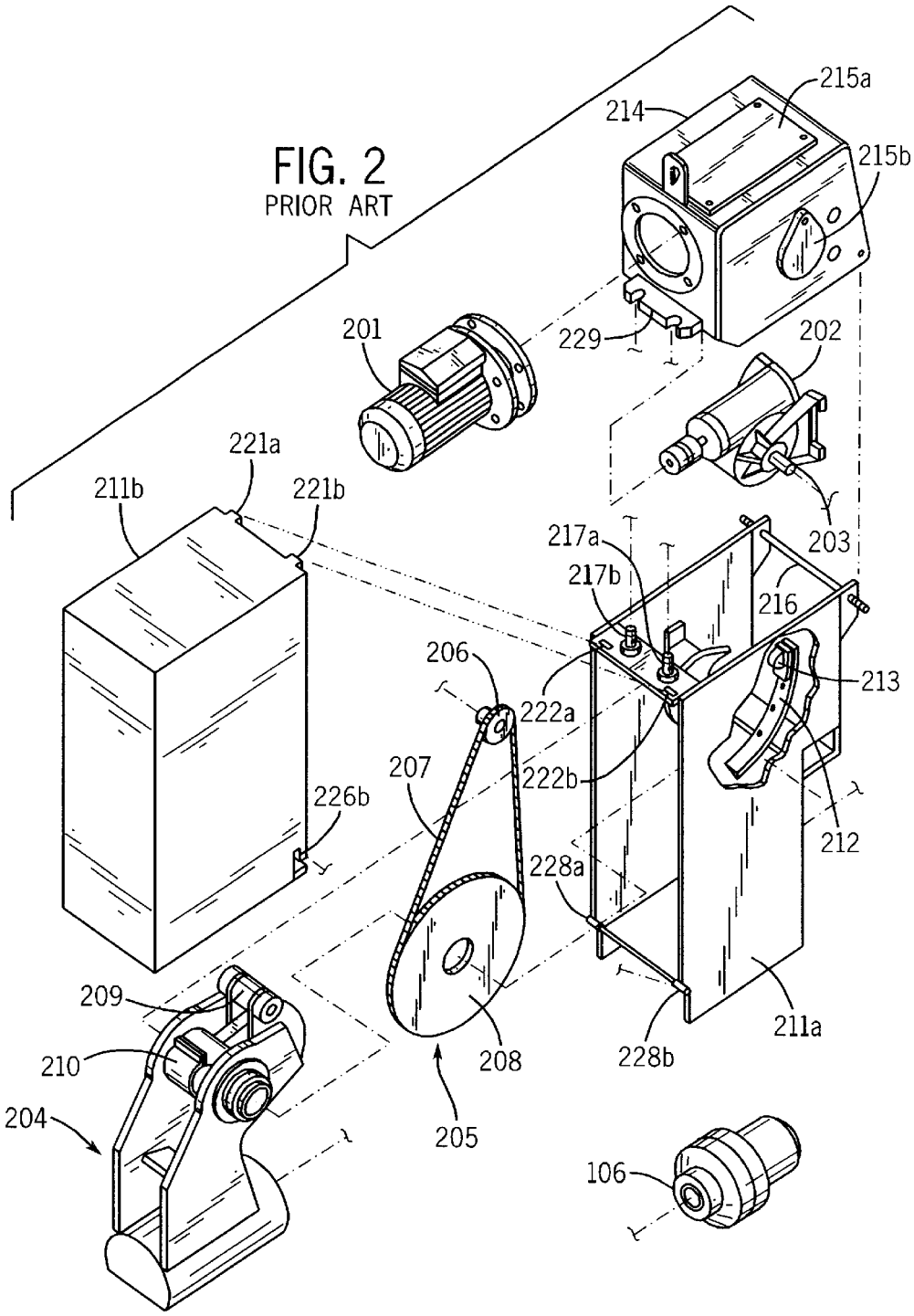
FIG. 2 PRIOR ART
FIG. 2 is an exploded view showing the component parts of a conventional rapper.

The design of conventional rappers as described in FIG. 2 does not lend itself to convenient and efficient maintenance. As shown in FIG. 2, the operating components of the rapper are sheltered in gear reducer housing 214 and hammer assembly housing 211*a* and 211*b*. The design of the conventional rappers allow access to the interior and contents of these housings either by gear reducer housing access panel 215 or by the removal of either or both gear reducer housing 214 and/or hammer assembly housing 211*b*. All of these maneuvers often prove inadequate.

With respect to access panel 215*a* it is located on the top of housing 214 and as such, it provides ready access only to the top of gear reducer 202. Access panel 215*b* provides principally inspection access to gear reducer shaft 203, small chain sprocket 206 and chain 207. For service access to either or both sides of gear reducer 202 usually requires removal of housing 214, and this can be awkward and time consuming.

Rappers are used in various combinations with one another (a large piece of equipment, e.g., a waste-heat boiler supporting a metallurgical furnace, may have more than 100 rappers attached to it), and they are often located (i) at difficult to reach spots on the equipment, e.g., 20 or 30 or more feet above the ground floor, or in a tight corner, or between various components of the equipment, etc., (ii) in close proximity to one another, and/or (iii) at an inconvenient angle (e.g., perpendicular) to the ground floor. As such, the single service access panel (i.e., 215*a*) to the interior of the assembly may not be available for use or does not provide access to the part or parts that require attention thus necessitating removal of either or both of the gear reducer and hammer assembly housings.

Figure 6:
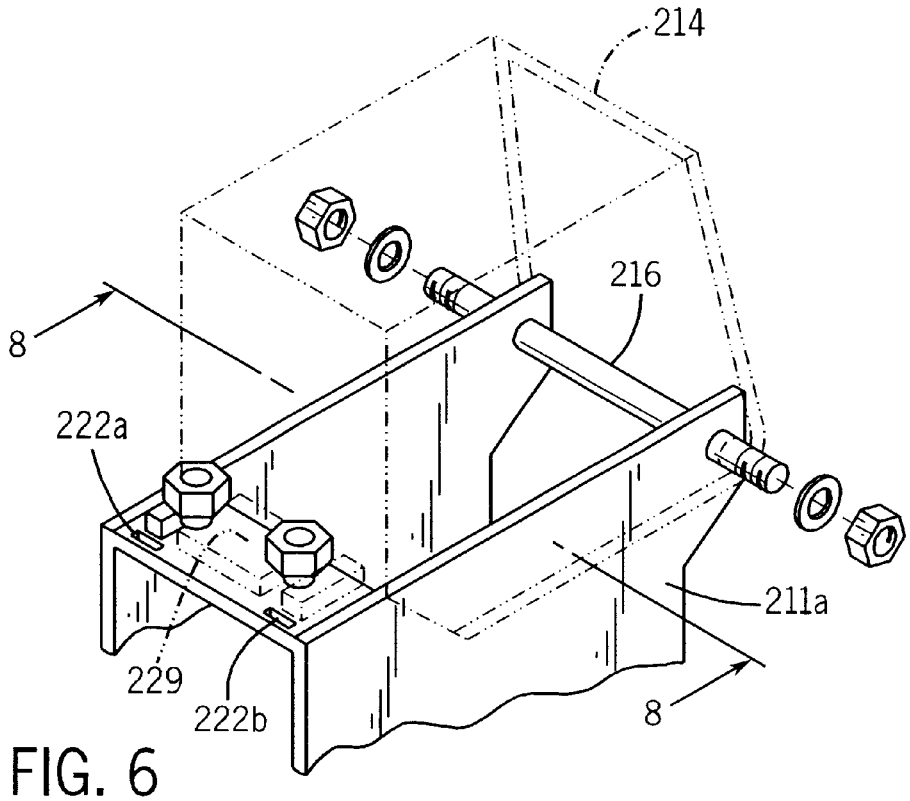
FIG. 6 PRIOR ART
FIG. 6 shows the attachment means for securing the gear reducer housing to the hammer housing of a conventional rapper.

With respect to the removal of these housings, the conventional designs do not lend themselves to a facile undertaking of such an endeavor in those instances in which the rappers are located close to one another, or in a tight corner, or Then positioned at an odd angle relative to the floor upon which the equipment rests. For example, gear reducer housing 214 is fastened to hammer assembly housing 211*a* by single, rear bolt 216 and front bolts 217*a* and 217*b* (FIGS. 2, 6 and 8). While access to these bolts is almost always available, the removability of the rear bolt is dependent, in part, upon the placement of the rapper relative to the adjacent rapper and/or the equipment to which it is attached. Since the rear bolt is of a length that exceeds the width of hammer assembly housing 211*a*, the rapper must be spaced sufficiently apart from at least one of the rappers adjacent to it on either side and from any obstruction on the equipment to allow its withdrawal. Moreover, replacing such a bolt in tight quarters is difficult given the need to align the fastening holes of gear reducer housing 214 with the fastening holes of hammer assembly housing 211*a*.

Figure 3:
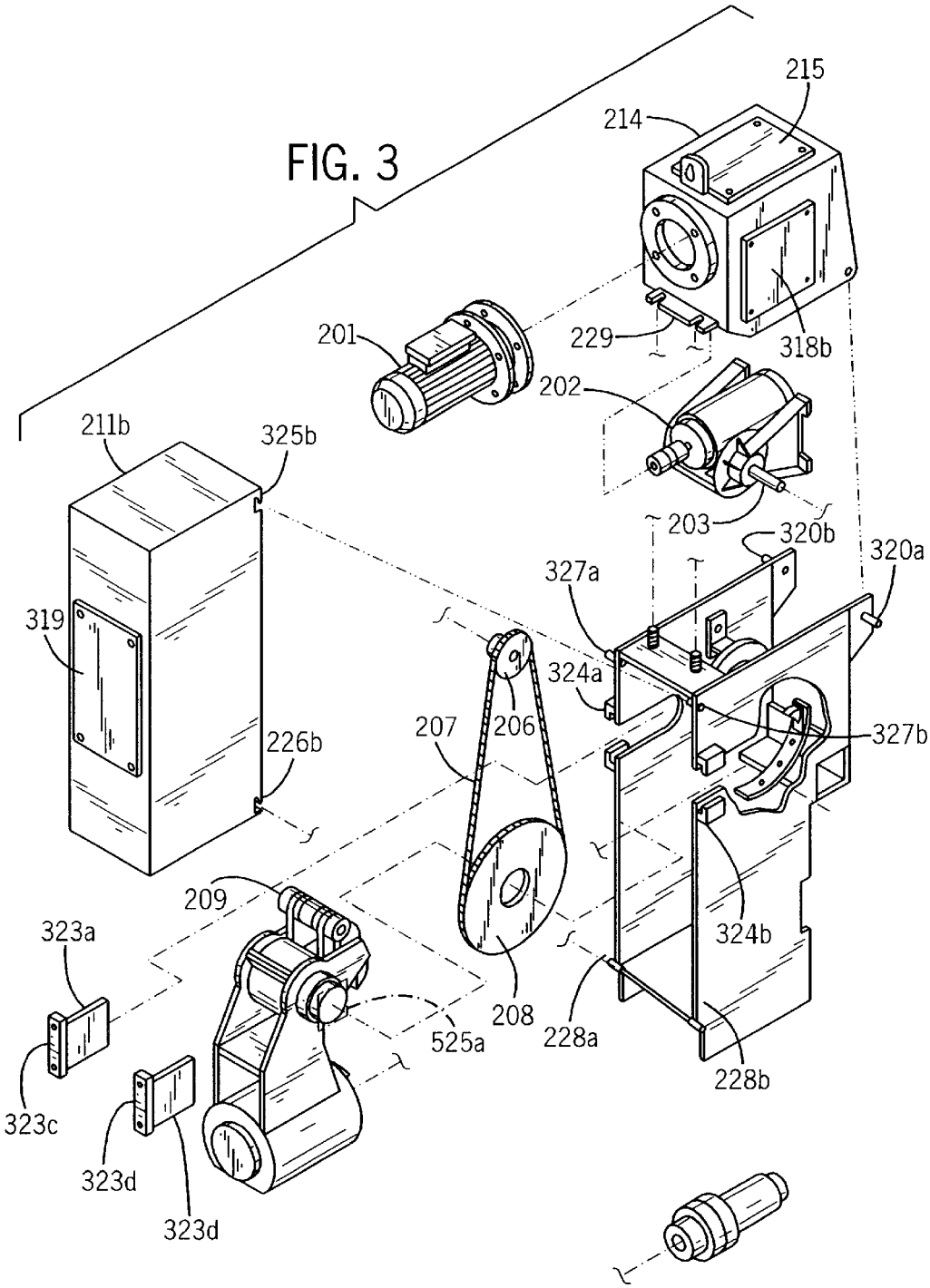
FIG. 3 is an exploded view showing the component parts of a rapper of the invention.

In a first embodiment of this invention, access to the rapper components within the gear reducer and hammer assembly housings is improved in two manners. First, better access is provided to the contents within both housings by the addition of access panels 318*a–b* and 319 (FIGS. 3 and 9). These housings can contain additional access panels (not shown). Panels 318*a–b* and 319 are of sufficient size and configuration to allow a workman adequate access to the contents of these housings to perform routine inspections and on-site maintenance. The panels can be attached to the housings by any convenient means such as bolts, hinges, tongue and groove fittings, and the like.

Figure 7:
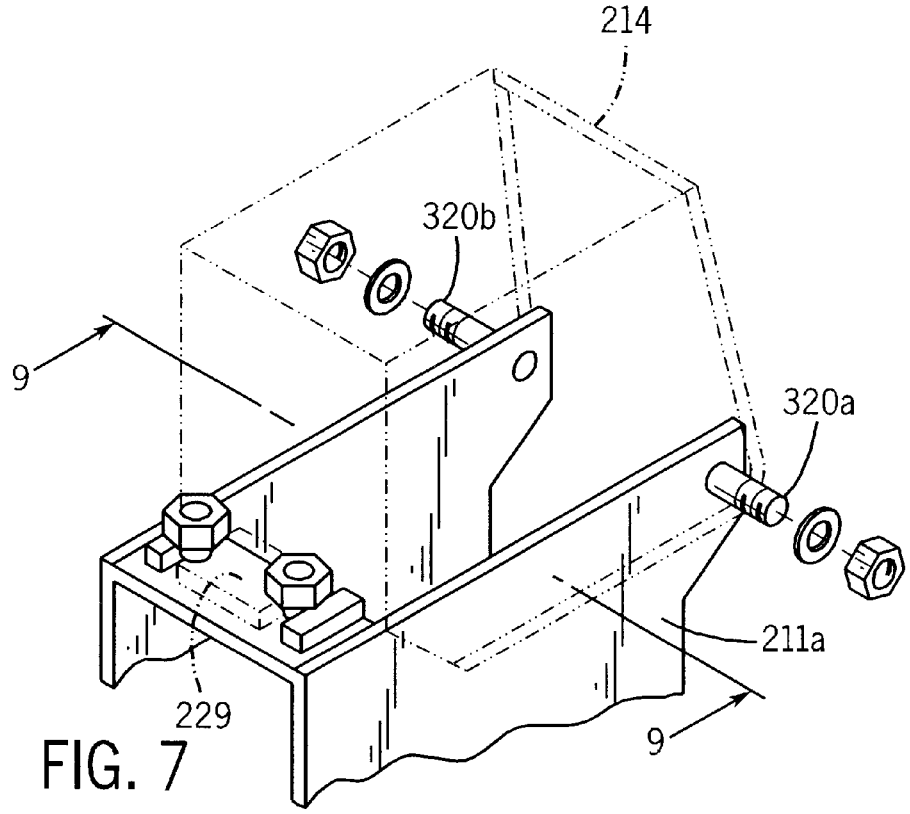
FIG. 7 shows the attachment means for securing the gear reducer housing to the hammer housing of a rapper of the invention.
Figure 10:
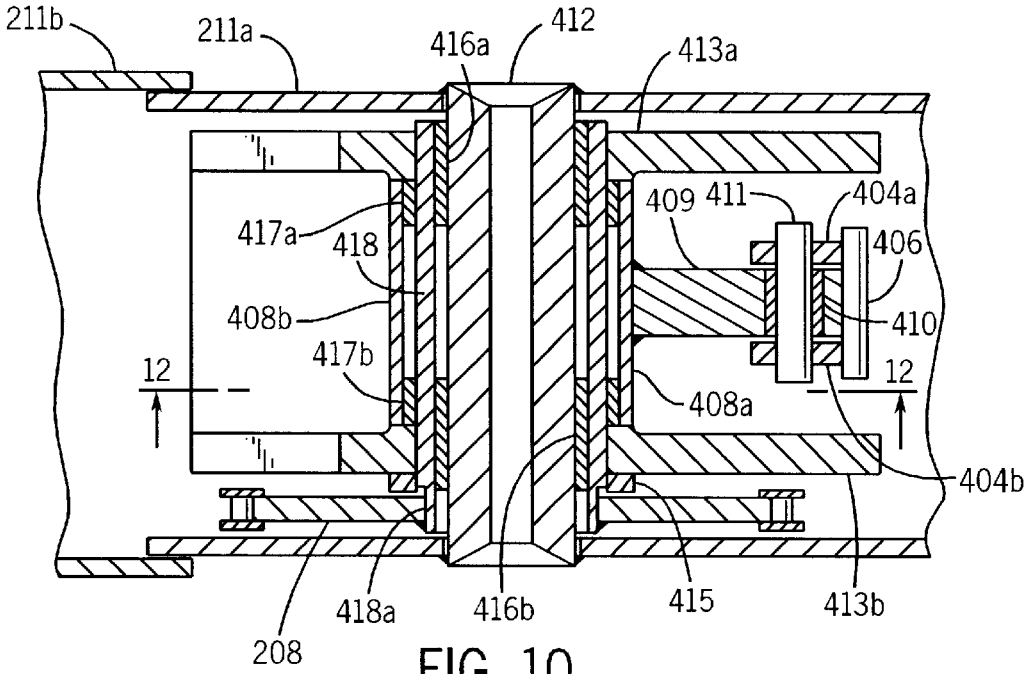
FIG. 10 PRIOR ART
FIG. 10 is a top perspective of the lever shaft assembly of a conventional rapper.

Second, in those instances in which entry to the interior of the housing through an access panel is inadequate, the housing can be removed with relative ease despite their proximity to other rapper housings or obstructions on the equipment to which the rapper is attached. With respect to the gear reducer housing, the single, long bolt is replaced with short bolts 320*a* and 320*b* (FIGS. 3, 7 and 9). Use of the bolts eliminate the difficulty of removing and inserting the single long bolt in tight quarters.

With respect to the hammer assembly housing, the fastening arrangement of tabs 221*a–b* on housing 211*b* fitting into slots 222*a–b*, respectively, on housing 211*a* (as shown in FIGS. 2 and 6), is replaced with the combination of (i) C-slots 325*a* (not shown) and b on housing 211*b* fitting over hanger bolts 327*a–b*, respectively, in housing 211*a*, and (ii) keepers 323*a–b* fitting into keeper blocks 324*a–b*, respectively (as shown in FIG. 3). C-slots 226*a* (not shown) and b at the bottom of housing 211*b* engage hanger bolts 228*a–b* at the bottom of housing 211*a*, and these remain unchanged from the original design. Removal and replacement of housing 211*b* is thus significantly facilitated in that visual alignment of tab and slot requires neither a top-down perspective nor head or swing space for positioning the tabs into the slots.

In another embodiment of this invention, the hammer assembly is improved to allow for more efficient maintenance. As described earlier, the hammer is subject to continuous use and given the nature of its work (i.e., impacting the anvil), its face and the lever and hammer shaft assemblies incur continuous stress and wear. As such, these components require periodic and frequent inspection and attention which occasionally requires removal of either the hammer assembly or at least the hammer. Depending upon such factors as rapper placement on the gas transport or processing equipment and its position relative to other rappers, removal and replacement of the hammer assembly can be difficult at best. The hammer component of the assembly often weighs 100 or more pounds itself and if located high above the floor on which the transport or processing equipment rests, or fitted into a tight position on the equipment, the sheer weight of the assembly makes its disengagement from the other assembly components difficult.

According to this embodiment, hammer 105 (FIG. 5) comprises a hammer shell 501 and hammer core 502. The hammer core is sized to fit snugly within hammer shell 501 such that it essentially fills hammer shell void 503. When inserted within hammer shell 501, hammer core 502 is held within it by hammer plate 504 which is fastened to shell 501 by any convenient means, e.g., bolts (not shown). Hammer core 502 is locked in place within void 503 with a bolt and lock nut (neither shown), the bolt threaded through plate 504 such that the end of the bolt engages core face 502*a* such as to secure tightly the core against the end wall (not shown) of void 503. Preferably, the end wall is about three (3) inches removed from the face of the hammer that strikes the anvil (or in other words, the face of the hammer that strikes the anvil is about 3 inches thick).

The hammer core is also sized to constitute a significant, e.g., 50% or more, of the hammer assembly weight. Accordingly, in those instances in which the assembly must be removed for inspection or maintenance, the core can be removed first and this, in turn, reduces the total weight of the remaining assembly for separate removal (and subsequent replacement). Removing and replacing the assembly in this piecemeal fashion greatly assists in the efficiency of the maintenance operation (often allowing one man to do what would otherwise require two or more men).

The hammer shell and core can be made in any suitable manner including separate manufacture or creating the core and shell from a single workpiece. As noted above, the core does not extend through the shell such that the core face distal from plate 504 impacts the anvil or in other words, shell void 503 does not extend through hammer shell 501 as a tunnel but rather it extends into it as a cave or recess. The geometry of the core and void can vary to convenience as can their relative position with the shell, e.g., each centered on their respective longitudinal axis, or a variation on this location.

Figure 5:
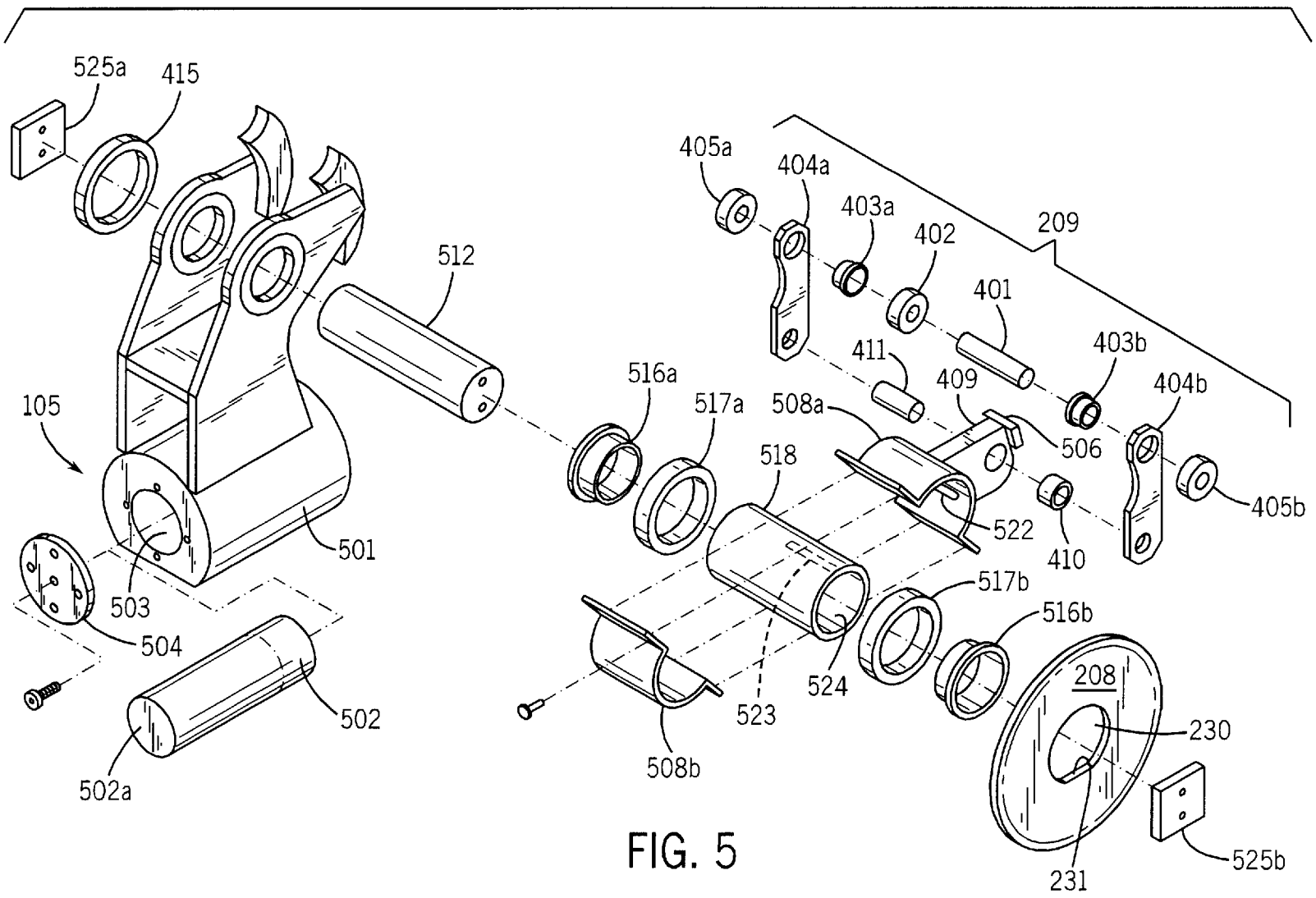
FIG. 5 is an exploded view showing the lever and hammer shaft assemblies of a rapper of the invention.
Figure 11:
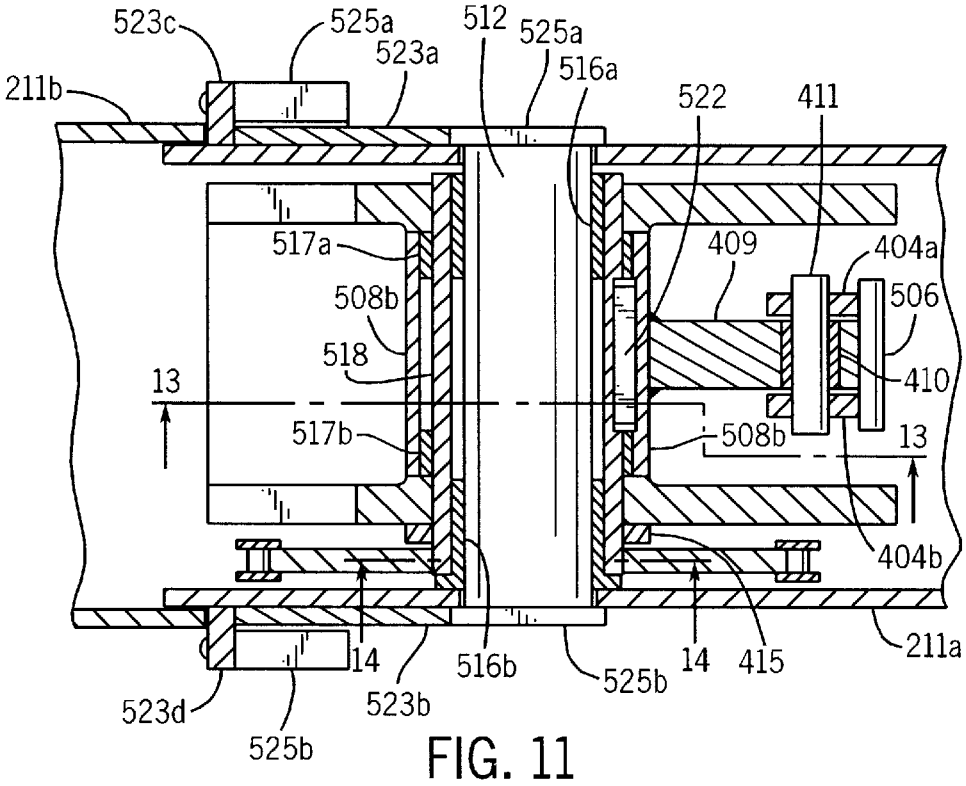
FIG. 11 is a top perspective of the lever shaft assembly of a rapper of the invention.

In another aspect of this embodiment, the removal and replacement of the hammer assembly from housing 211*a* is further improved by the addition of keeper guide plates 525*a–b* (FIGS. 5, 11 and 3 (shown in phantom-line)) to shaft 512 (one plate on each end of the shaft). The plates are affixed by any conventional means, e.g., threaded bolts through the plate and into an appropriately adapted threaded holes in the end of the shaft, and the plates are sized and configured to fit snuggly into keeper blocks 324*a–b* respectively. The blocks act both as a guide for inserting the hammer assembly into housing 211*a* and when combined with keepers 323*a–b*, as a lock for keeping the assembly in place. In a manner similar to the manner in which the plates are affixed to the shaft, the keepers are affixed to the keeper blocks with threaded bolts inserted through keeper faceplates 323*c–b* into threaded holes in the keeper blocks (FIGS. 3 and 11).

Although better access and ability to inspect and service the rapper is provided by the inventive embodiments described above, from an inspection and service perspective, preferably the rapper is designed to require less of each. Toward this end, another embodiment of the invention is illustrated through a comparison of FIGS. 4 and 5.

Figure 4:
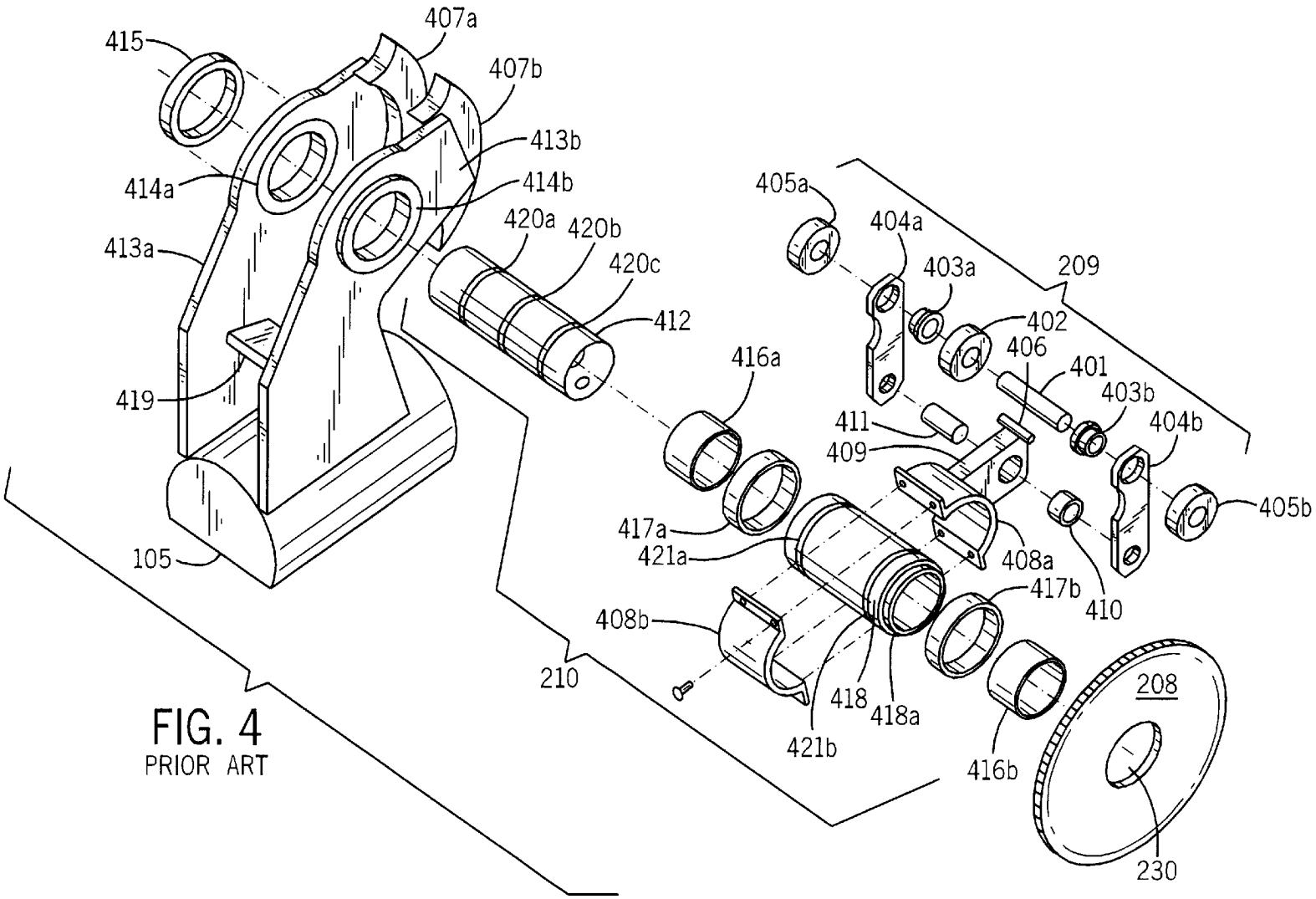
FIG. 4 PRIOR ART
FIG. 4 is an exploded view showing the lever and hammer shaft assemblies of a conventional rapper.

In FIG. 4, conventional hammer shaft assembly 210 comprises hammer shaft 412 and hammer shaft bushing 418 each with machined grooves 420*a–c* and 421*a–b*, respectively. Such grooves require routine maintenance to ensure adequate greasing, and thus periodic disassembly of the hammer shaft assembly. In the improved design of this inventive embodiment (FIG. 5), hammer shaft 412 is replaced with hammer shaft 512 and hammer shaft bushing 418 is replaced with hammer shaft bushing 518, both of which are without grease grooves. Instead, hammer shaft bushings 417*a–b* are replaced with self-lubricating bushings 517*a–b*. The maintenance step of greasing the hammer shaft and bushing is thus eliminated (other than replacing a worn bushing the frequency of which is much less than that of manually greasing the shaft and bushing).

Another improvement in the hammer shaft assembly design is the manner in which hammer shaft casing 408 engages hammer shaft bushing 418. In the conventional assembly, casing 408 engages bushing 418 through a compression fit which results from bolting the two casings halves to one another. However, this allows for slippage over time which, in turn, requires maintenance to adjust the casing back to its original fit about the bushing. In contrast, casing half 508*a* carries key 522 on its inside surface which is sized and configured to engage firmly slot 523 on bushing 518. When this key and slot are joined with one another, the fit between bushing and shaft is much more resistant to slippage than that provided simply through compression alone.

Yet another design improvement in the hammer shaft assembly is in the manner in which bushing 418 engages large chain sprocket 208. In the conventional design as shown in FIG. 4, the bushing is cylindrical and opening 230 is annular and sized to accept bushing neck 418*a* in a snug fit. The bushing is then permanently affixed to the sprocket by any conventional means, e.g., welding one to the other, typically to both faces of the sprocket. However, given the nature of the constant pounding that this equipment not only delivers but also experiences, welds tend to weaken and break over time and this, in turn, results in a temporary decommissioning of the rapper.

Figure 1:
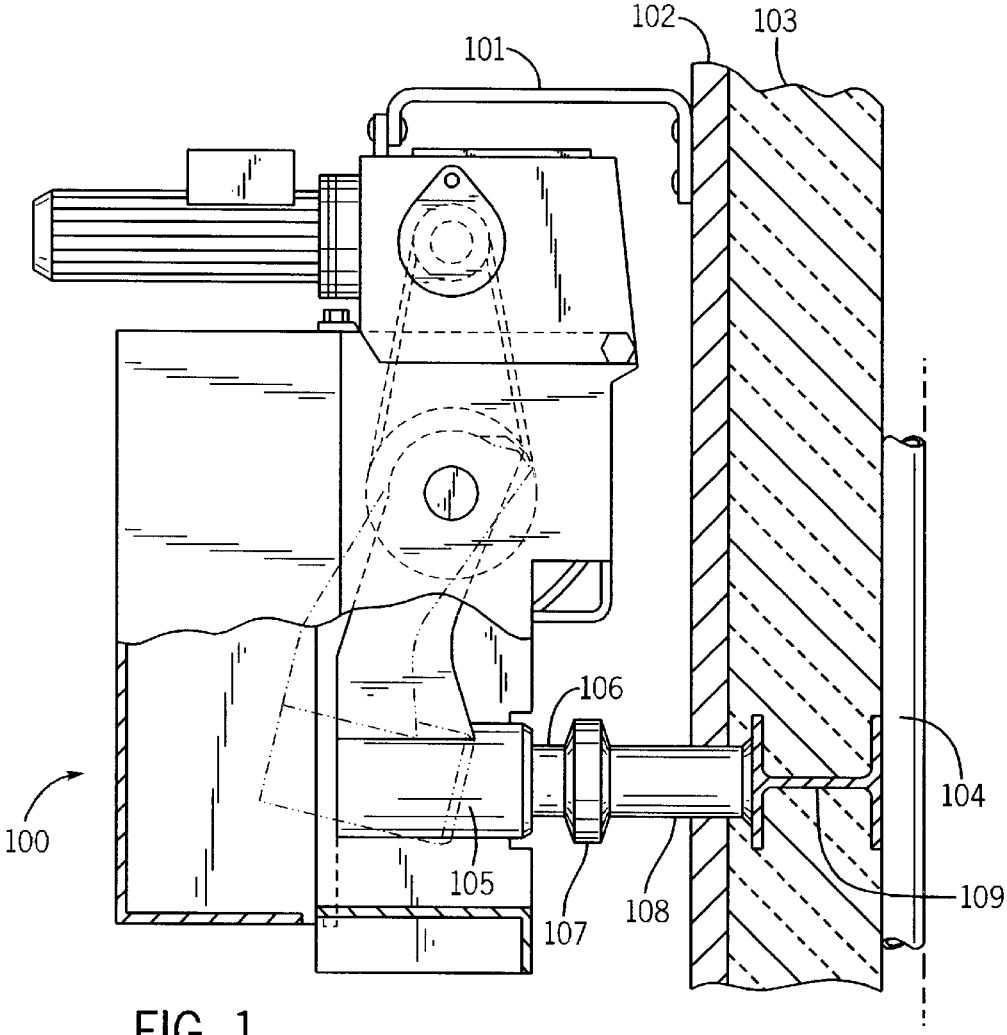
FIG. 1 PRIOR ART
FIG. 1 is a side, cut-away perspective of a rapper attached to the sidewall of an apparatus for transporting or processing a hot, dust-laden gas. The phantom-line drawing illustrates the hammer in a retracted position.
Figure 14:
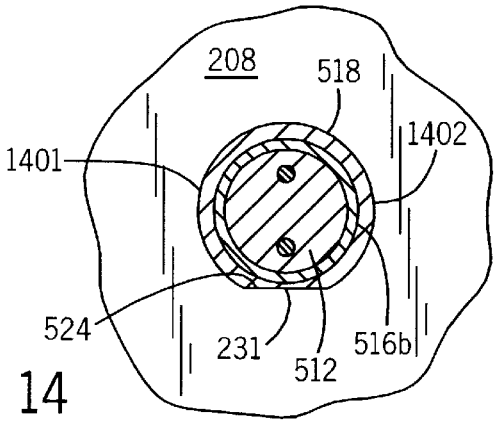
FIG. 14 is a side perspective showing the keyed engagement of the hammer shaft to the large chain sprocket of a rapper of the invention.

In this design improvement, the bushing and sprocket opening are keyed to one another by any suitable means, e.g., in FIG. 5 by imparting flat surface 231 to the annulus that defines opening 230 and flat surface 524 to bushing 518. This key arrangement also eliminates neck 418*a* which, in turn, results in a simpler bushing design. Other key designs are also available, e.g., changing the configuration of opening 230 from circular to elliptical, square, diamond, etc. This key arrangement is best used in combination with the conventional practice of welding and provides a convenient "back-up" system for permanently engaging hammer shaft bushing 518 with large chain sprocket 208. In other words, if a weld breaks, the rapper can remain operational because the key arrangement prevents slippage between the sprocket and bushing. FIG. 14 provides an end-on-view of bushing 518 engaging sprocket 208 in a keyed arrangement and with welds 1401 and 1402 in place.

In yet another design improvement, stop pin 406 on casing arm 409 (FIG. 4) is replaced with stop block 506 (FIG. 5). As noted earlier, the function of the stop pin is to engage levers 404*a–b* so that middle bearing 402 will engage in the hammer saddle after the hammer is released. Stop pin 406 is typically made from a soft metal (relative to the metal from which casing arm 409 is made), and it is typically welded to casing arm 409. However, the constant engagement of the levers has a tendency to weaken and eventually break the pin. Stop block 506 in contrast, offers a larger surface area over which to engage levers 404*a–b*, thus enhancing its durability relative to the pin and in a preferred embodiment, it is machined from the same block of metal that forms the casing arm. This further increases the durability of the block as compared to the pin.

Although the invention has been described in considerable detail, this detail is primarily for the purpose of illustration. Variations can be made on the invention as described above without departing from the spirit and scope of the invention as described in the appended claims.

What is claimed is:

1. A rapper hammer comprising:

a. A shell comprising a recess with an end wall;

b A core sized and configured to fit snugly within the recess of the shell, the core shorter in length than the recess of the shell;

c. A plate detachably affixed to the shell so as to retain the core within the recess; and d. A retention bolt adapted to thread through the plate and to engage the core such that the core is abutted against the end wall of the recess.

2. The rapper hammer of claim 1 in which the core is sized to essentially fill the recess of the shell.

3. The rapper hammer of claim 1 in which the plate is detachably affixed to the shell with bolts.

4. The rapper hammer of claim 1 in which the core constitutes at least about 50% of the weight of the rapper hammer.

5. The rapper hammer of claim 1 in which the shell and core have a generally cylindrical configuration.

6. The rapper hammer of claim 1 in which both the core and shell are centered on their respective longitudinal access.

* * * * *